US006299654B1

(12) United States Patent
Thompson

(10) Patent No.: US 6,299,654 B1
(45) **Date of Patent: *Oct. 9, 2001**

(54) AMINE AZIDES USED AS MONOPROPELLANTS

(75) Inventor: Darren M. Thompson, Madison, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/618,411

(22) Filed: Jul. 18, 2000

(51) Int. Cl.[7] ..... C10L 1/22; C06B 47/00

(52) U.S. Cl. ..... 44/265; 44/327; 149/1; 149/17; 149/45; 149/74; 149/190.4; 149/60; 149/211

(58) Field of Search ..... 44/327, 265; 149/1, 149/17, 45, 74, 190.4; 60/211

(56) References Cited

U.S. PATENT DOCUMENTS

| | | | | |
|---|---|---|---|---|
| 4,120,151 | * | 10/1978 | Quigley | 60/39.46 M |
| 4,620,415 | * | 11/1986 | Schmidt | 60/219 |
| 4,741,742 | * | 5/1988 | Miller et al. | 44/327 |
| 5,133,183 | | 7/1992 | Asaoka et al. | 60/204 |
| 5,152,136 | * | 10/1992 | Chew et al. | 60/251 |
| 5,621,156 | * | 4/1997 | Thompson | 44/266 |
| 6,013,143 | | 1/2000 | Thompson | 149/1 |
| 6,210,504 | * | 4/2001 | Thompson | 149/1 |

* cited by examiner

*Primary Examiner*—Margaret Medley
(74) *Attorney, Agent, or Firm*—Arthur H. Tischer; Freddie M. Bush

(57) ABSTRACT

The subjects of this patent are three amine azide monopropellants, dimethylaminoethylazide (DMAZ), pyrollidinylethylazide (PYAZ) and diethylaminoethylazide (DEAZ). Amine azides decompose on an iridium catalyst at 400° F. and have very low freezing points (<-65° F.). Dimethylaminoethylazide (DMAZ) has been tested and is a suitable replacement for hydrazine in monopropellant thruster applications. An amine azide can be used as a non-carcinogenic alternative for any monopropellant system using hydrazine. An amine azide could be used to replace hydrazine in thrust vector control or reactive control applications for space based applications. An amine azide could be used to replace hydrazine in divert attitude control systems in interceptor missile systems. In a gel fuel formulation the tertiary amine azide gel can have 0.5%–10% gellant. The gellant can be silicon dioxide, clay, carbon or any polymeric gellant. The amine azide gel can also include additives that could improve the specific impulse and density impulse. These solid additives include but would not be limited to amine-nitrate salts, quaternary ammonium salts or other high-density additives. The formulation can vary over the following ranges 1%–90% solid additive, 100%–10% tertiary amine azide and 0.5%–10% gellant.

4 Claims, 1 Drawing Sheet

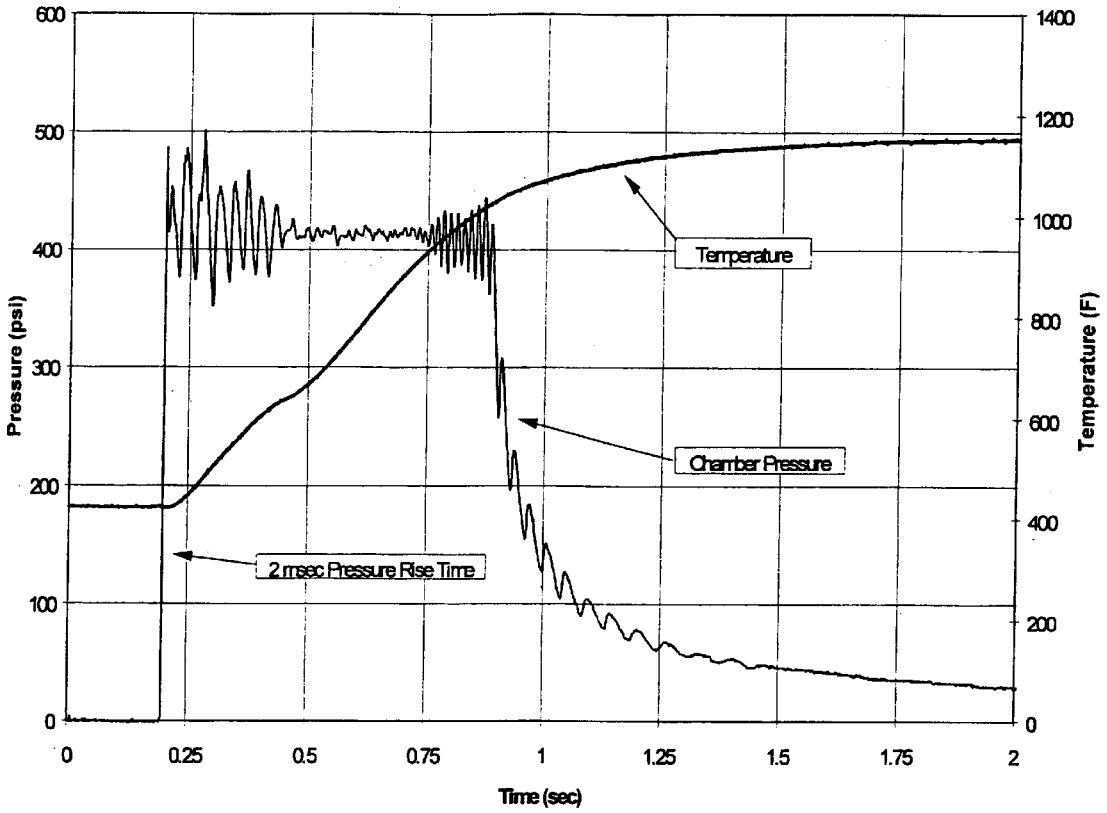
600
500
400
300
200
100
0
Pressure (psi)
1400
1200
1000
800
600
400
200
0
Temperature (F)
0
0.25
0.5
0.75
1
1.25
1.5
1.75
2
Time (sec)
Temperature
Chamber Pressure
2 msec Pressure Rise Time

AMINE AZIDES USED AS MONOPROPELLANTS

BACKGROUND OF THE INVENTION

A liquid or gel monopropellant thruster consists of a pressurization system, propellant tank, fuel valve, and a catalytic bed reactor with a nozzle. The thruster begins operation when the pressurization system has been activated and the monopropellant is pressurized in the propellant tank. When the fuel valve opens, the pressurized monopropellant is expelled into the catalytic bed reactor where the monopropellant is exothermically decomposed into small molecular weight gasses. Hydrazine and hydrazine blends have been considered as monopropellants because of their ability to decompose at ambient conditions on an iridium catalyst to form warm (1000° F. to 1500° F.) gases. Hydrazine is undesirable because of its toxicity and high freezing point (34° F.).

SUMMARY OF THE INVENTION

The subjects of this patent are three amine azide monopropellants, dimethylaminoethylazide (DMAZ), pyrollidinylethylazide (PYAZ) and diethylaminoethylazide (DEAZ). Amine azides decompose on an iridium catalyst at 400° F. and have very low freezing points (<−65° F.). Dimethylaminoethylazide (DMAZ) has been tested and is a suitable replacement for hydrazine in monopropellant thruster applications.

Heat of formation and density data has been collected for all three compounds and DMAZ has been tested in a catalytic bed reactor. The amine azides DMAZ and PYAZ have already been shown to be good hypergolic fuels with inhibited red fuming nitric acid. These compounds are good candidates for monopropellants because the azide moiety present in each fuel decomposes exothermically to sustain the operation of the catalytic bed reactor.

Calorimetry methods have been used to determine the heats of formation of the compounds since this information has not been published in the open literature. The freezing points have been verified using differential scanning calorimetry (DSC) methods. The boiling points have been determined by observation.

BRIEF DESCRIPTION OF THE DRAWING

The FIGURE of the drawing shows the pressure of the gas generator reactor during operation using DMAZ. Hydrazine was used to preheat the reactor. DMAZ was flowed when the reactor cooled to 400° F. DMAZ demonstrated a very fast pressure rise time of 2 milliseconds for this test. The temperature and pressure generated from these flow conditions are very similar to hydrazine gas generator tests.

DESCRIPTION OF THE PREFERRED EMBODIMENT

An amine azide can be used as a non-carcinogenic alternative for any monopropellant system using hydrazine. An amine azide could be used to replace hydrazine in thrust vector control or reactive control applications for space based applications. An amine azide could be used to replace hydrazine in divert attitude control systems in interceptor missile systems. In a gel fuel formulation the tertiary amine azide gel can have 0.5%–10% gellant. The gellant can be silicon dioxide, clay, carbon or any polymeric gellant. The amine azide gel can also include additives that could improve the specific impulse and density impulse. These solid additives include but would not be limited to amine-nitrate salts, quaternary ammonium salts or other high density additives. The formulation can vary over the following ranges 1%–90% solid additive, 100%–10% tertiary amine azide and 0.5%–10% gellant.

BRIEF DESCRIPTION OF TABLE 1

Table 1 below displays the physical and ballistic properties of the amine azide fuels that have been synthesized and characterized recently. All of the fuels have freezing points less than −65° F., so additives to lower the freezing point are not necessary. Pyrollidinylethylazide (PYAZ) as the broadest boiling point to freezing point range of the fuels as well as a much lower freezing point. The amine azides all have very high positive heats of formation.

TABLE 1

Chemical Properties of the Tertiary Amine Azides

| Compound # | Boiling Point (° F.) | Freezing Point (° F.) | Heat of Formation (cal/g) | Density (g/cc) |
|---|---|---|---|---|
| 1 | 276 | −92 | +580 | 0.933 |
| 2 | 337 | −98 | +413 | 0.896 |
| 3 | d-310 | −176 | +520 | 0.986 |

Compound #1—Dimethylaminoethylazide (DMAZ)

Compound #2—Diethylaminoethylazide (DEAZ)

Compound #3—Prollidinylethylazide (PYAZ)

Dimethylaminoethylazide (DMAZ) has the following structure:

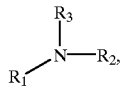

wherein $R_1$=—$CH_3$, $R_2$=—$CH_3$,

Dimethylaminoethylazide (DEAZ) has the following structure:

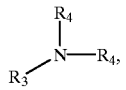

wherein $R_3$ is as previously defined and wherein $R_4$=—$CH_2CH_3$.

Pyrollidinylethylazide (PYAZ) has the following structure:

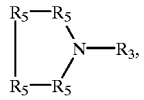

wherein $R_3$ is as previously defined and wherein $R_5$ is —$CH_2$.

I claim:

1. A liquid or gel monopropellant gas generator consisting essentially of:

(i) a tertiary amine azide which decomposes exothermically to release sufficient heat to sustain decomposition in an iridium catalytic reactor bed, said tertiary amine azide selected from the group of tertiary amine azides consisting of dimethylaminoethylazide, pyrollidinylethylazide, and diethylaminoethylazide, and said tertiary amine azide being capable of being decomposed by an iridium catalyst to yield gaseous products; and (ii) an iridium catalytic reactor bed preheated to above 400° F. to enable said iridium catalytic reactor bed to achieve a self sustaining decomposition reaction of said tertiary amine azide when said tertiary amine azide is added to said preheated iridium catalytic reactor bed to yield gaseous products under pressure for pressurization of a hypergolic liquid or gel fuel propulsion system.

2. The liquid or gel monopropellant gas generator as defined in claim 1 wherein said tertiary amine azide is dimethylaminoethylazide having the following structure:

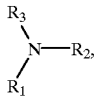

wherein $R_1$=$CH_3$, $R_2$=—$CH_3$, $R_3$=—$CH_2CH_2N_3$.

3. The liquid or gel monopropellant gas generator as defined in claim 1 wherein said tertiary amine azide is pyrollidinylethylazide having the following structure:

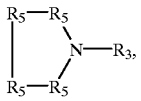

wherein $R_3$ is as previously defined and wherein $R_5$ is —$CH_2$.

4. The liquid or gel monopropellant gas generator as defined in claim 1 wherein said tertiary amine azide is diethylaminoethylazide having the following structure:

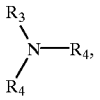

wherein $R_3$=—$CH_2CH_2N_3$ and $R_4$=—$CH_2CH_3$.

* * * * *